US006227614B1

(12) United States Patent
Rubin

(10) Patent No.: US 6,227,614 B1
(45) Date of Patent: May 8, 2001

(54) CASINO CHAIR

(76) Inventor: Ben Rubin, 104-60 Queens Blvd. Suite 10 C, Forest Hills, NY (US) 11375

( * ) Notice: Subject to any disclaimer, the term of this patent is extended or adjusted under 35 U.S.C. 154(b) by 0 days.

(21) Appl. No.: 09/338,472

(22) Filed: Jun. 22, 1999

(51) Int. Cl.[7] ..... A47B 83/00
(52) U.S. Cl. ..... 297/172; 297/143; 297/344.1
(58) Field of Search ..... 297/143, 140, 297/170, 172, 174, 217.1, 344.1

(56) References Cited

U.S. PATENT DOCUMENTS 1,417,655 * 5/1922 Zielinski ..... 297/143
2,244,531 * 6/1941 Elder ..... 297/143
2,652,887 * 9/1953 Fitzgerald ..... 297/188.14
5,547,270 * 8/1996 Dang ..... 297/143 X
5,673,968 * 10/1997 Ponzio ..... 297/143

FOREIGN PATENT DOCUMENTS

2717729 * 10/1978 (DE) ..... 297/172
313999 * 1/1934 (IT) ..... 297/143

* cited by examiner

*Primary Examiner*—Peter R. Brown
(74) *Attorney, Agent, or Firm*—Bauer & Schaffer, LLP

(57) ABSTRACT

A casino chair selectively movable from a first position adjacent a casino gaming table to a second position spaced therefrom. The casino chair includes a seat, a backrest, a plurality of legs extending from the seat, and a mounting assembly for operably mounting the chair to the casino gaming table. The mounting assembly permits the selective movement the chair from a position adjacent the table to a position spaced therefrom. Further, the mounting assembly automatically returns the chair to the position adjacent the gaming when the chair is not in use.

7 Claims, 6 Drawing Sheets

CASINO CHAIR

BACKGROUND OF THE INVENTION

The present invention relates to a chair, and in particular, to a chair for use in a casino environment.

Numerous stools and chairs are known in the prior art. In addition many of these chairs and stools are designed to be used in a casino environment. Examples of such stools and chairs can be found in U.S. Pat. Nos. Des. 384,213, Des. 372,132 and Des. 384,212.

Casino chairs of the type described above generally fall in to one of two categories, chairs that are fixed to either the casino floor or gaming table/apparatus to which they are associated and chairs that are free to be positioned by the user. Both types of chairs have inherent problems when used in the casino environment.

Chairs that fall into the first category (i.e. fixed position chairs) can not be positioned or moved to suit the comfort needs of the user. This is particularly troublesome for large and/or obese individuals. Further, as the chairs can not be moved, it is difficult to enter or exit the gaming table without disturbing the other players.

Chairs that fall in the second category (i.e. free standing chairs) are also troublesome. First, although they may be freely moved to suit the comfort needs of the player, the chairs are often moved too far from the table during use thereby blocking or interfering with the aisles of the casino. Further, one player may position his chair in such a manner that it interferes with an adjacent player. Finally, when players leave the table they often leave the chairs in a scattered manner. This creates a unseemly look in the gaming room where appearance is always of the utmost importance for the casino. In addition, the chairs in this scattered state consume usable space around and adjacent the gaming table. This translates into a direct loss of profits for the casino as they must allot more space for non-gaming areas (e.g. aisles) thereby diminishing the number of tables they can fit into a given amount of space.

In addition to the chairs discussed above, some other adjustable casino chairs are found in the prior art. These chairs are high-end electromechanical units. However, these chairs are ill-suited for general purpose use in a casino for a number of reasons. First, these chairs are large units that would be impractical for use at gaming tables where space is at a premium. In addition, these electromechanical chairs are both expensive and complex in construction.

In my prior application, U.S. application Ser. No. 08/898,298 and my prior U.S. patent, U.S. Pat. No. 5,882,255, I disclose a smoke removal apparatus for use in a casino environment. In order for a smoke removal apparatus to effectively clean a casino it must be able to be installed and used at each of the gaming tables, including the poker table, blackjack table and others. Chairs found in the prior art are not designed nor adapted to accommodate a smoke removal apparatus of the type disclosed in my prior application and patent. As such, it would be difficult, if not impossible, to utilize the smoke removal apparatus as disclosed in my prior application and patent at each of the gaming tables found in the casino.

It is therefore, an object of the present invention to provide a casino chair that is very comfortable for the player and allows the player to position the chair as close to the game as the player's physical dimensions allow, thereby allowing the player to become intimately involved with the game that is being challenged.

It is also an object of the present invention to enable greater use of the backrest of the chair than is permitted by conventional chairs.

It is another object of the present invention to provide a casino chair that enables easy entry and exit from the gaming table or apparatus.

It is still another object of the present invention to provide a casino chair that enables a player to seat himself at a gaming table and remove himself therefrom without interfering with adjacent players.

It is a yet another object of the present invention to provide a casino chair that allots equal space for all players at a gaming table.

It is yet further object of the present invention to provide a casino chair that maximizes usable gaming space area for the casino.

It is an additional object of the present invention to provide a casino chair that is adapted to accommodate a smoke removal apparatus.

SUMMARY OF THE INVENTION

A casino chair selectively movable from a first position adjacent a casino gaming table or apparatus to a second position spaced from the casino gaming table or apparatus.

The casino chair includes a seat, a backrest, a plurality of legs extending from the seat and a mounting assembly for operably mounting the chair to the casino gaming table or apparatus. The mounting assembly includes means for selectively moving the chair from a position adjacent the gaming table or apparatus to a position spaced therefrom. The chair is further provided with means for automatically returning the chair to a position adjacent the gaming table or apparatus when the chair is not occupied.

DETAILED DESCRIPTION OF THE INVENTION

The present invention relates to a casino chair, generally depicted by the numeral 10 in the Figures.

Figure 1:
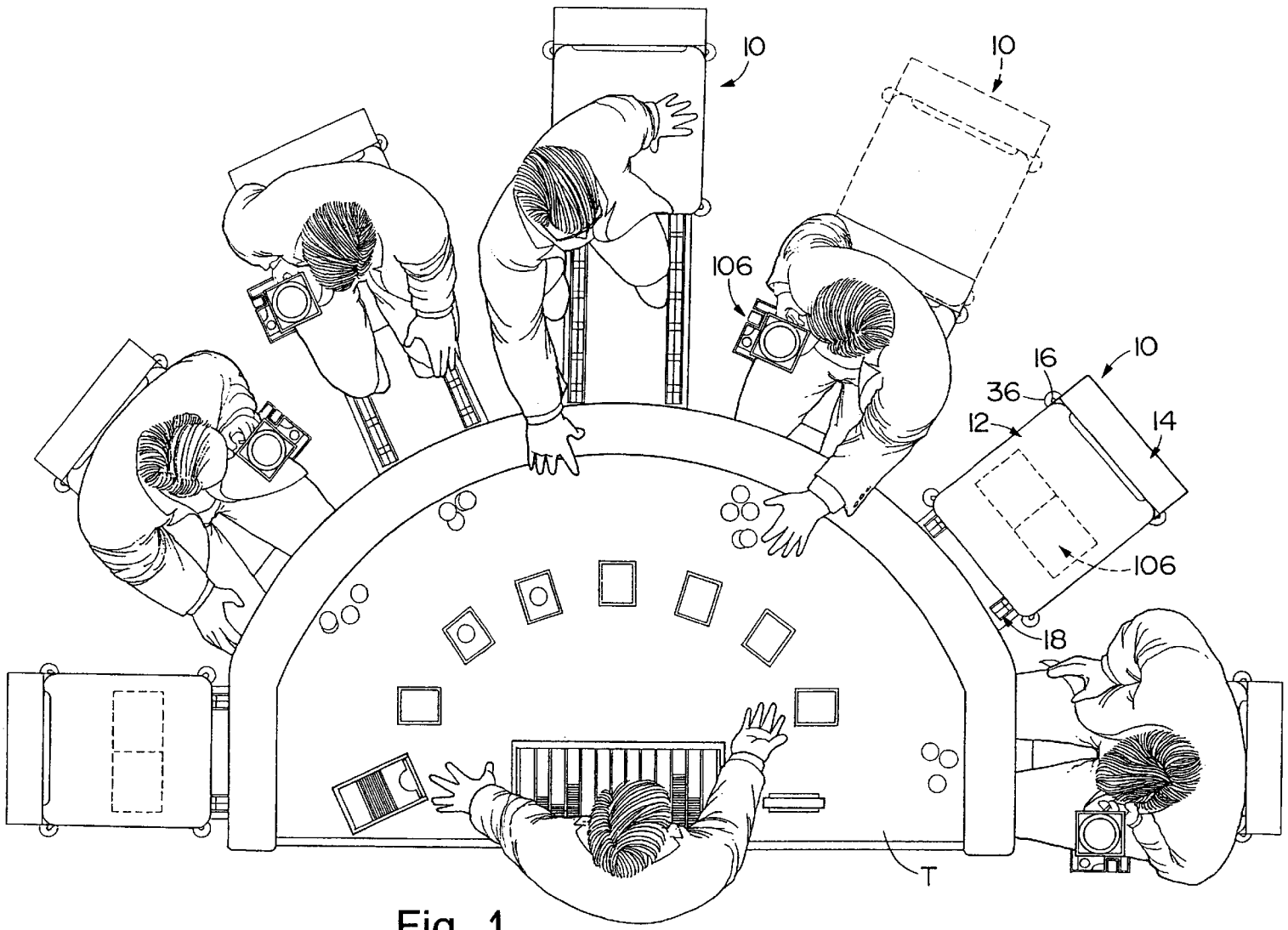
FIG. 1 is a schematic plan view of a gaming table at which a plurality of casino chairs according to the present invention are employed.
Figure 2:
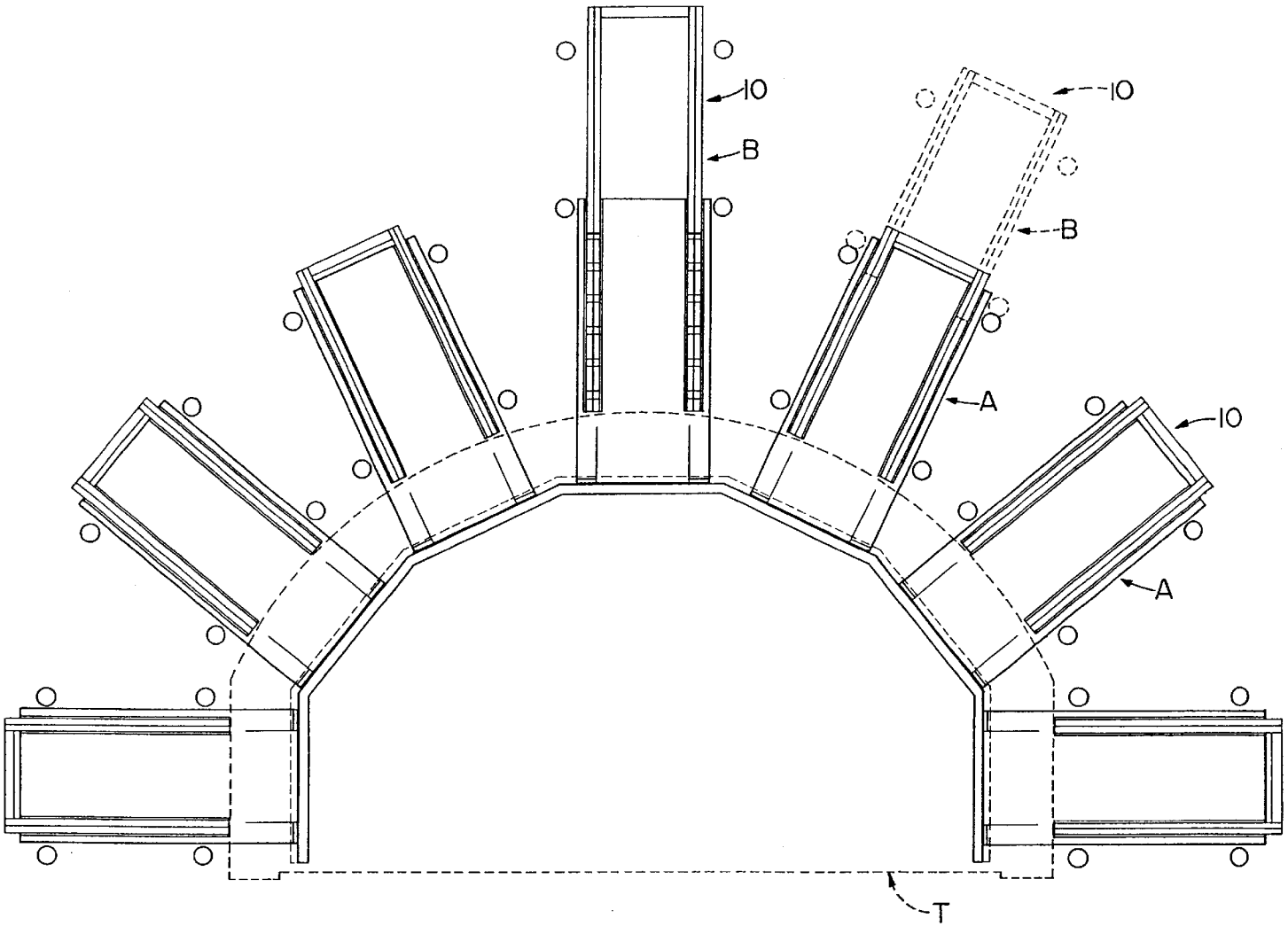
FIG. 2 is a schematic view similar to that shown in FIG. 1 showing the movement of the casino chair according to the present invention from a position adjacent the gaming table to a position spaced therefrom.

As shown in the schematic drawings of FIGS. 1 and 2, a plurality of chairs according to the present invention may be used in combination with a conventional gaming table T. As shown, the chairs 10 are equally spaced about the periphery of the table and are movable from a first position, A, adjacent the table to a second position, B, spaced from the table. As will be discussed in greater detail hereinafter, this enables a player to easily enter and exit the gaming table without interfering with any adjacent player.

Figure 3:
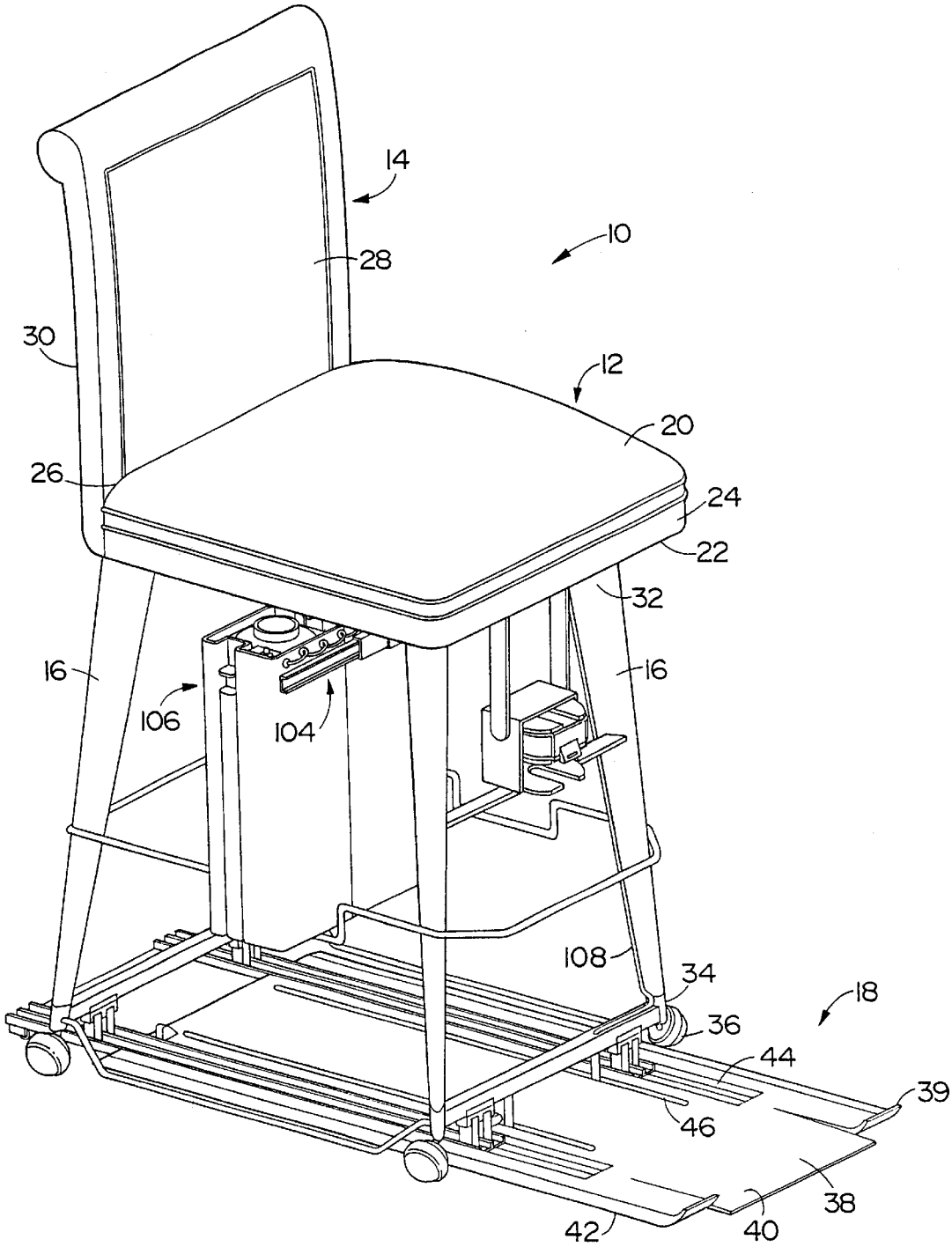
FIG. 3 is perspective view of the casino chair according to the present invention.

A perspective view of the casino chair 10 according to the present invention is shown in FIG. 3. The casino chair 10 includes a seat 12, a backrest 14, a plurality of legs 16 and a mounting assembly 18.

The seat 12 includes upper and lower substantially parallel surfaces, 20 and 22 respectively. The seat also includes substantially parallel front and rear surfaces, 24 and 26 respectively.

Mounted to the rear surface 26 of the seat 12 and extending vertically upward therefrom is the backrest 14. The backrest 14 includes substantially parallel front and back surfaces 28 and 30.

Mounted to the lower surface 22 of the seat 12 is a plurality of legs 16. Each of the legs include a first terminal end 32 secured to the lower surface 22 of the seat and a second terminal end 34. Each second terminal end is provided with rolling means, such as the caster 36 shown in Figures. The rolling means, as will be discussed in greater detail hereinafter, aids in permitting the selective adjustment of the chair by the user relative to the gaming table.

The chair 10 includes a mounting assembly 18 that operably connects the chair to the gaming table or gaming apparatus. Alternatively, the mounting assembly may be secured in a conventional manner adjacent the gaming table or gaming apparatus. The mounting assembly also includes means for enabling the selective movement of the chair relative to the gaming table or gaming apparatus.

The mounting assembly 18 includes a substantially planar base plate 38 having upper and lower surfaces, 40 and 42 respectively. The base plate 38 is secured to either the casino floor or to the gaming table/apparatus with which the chair is being used. As shown in FIG. 3, the front end of the base plate 38 is provided with a pair of upwardly curved portions 39 adapted to be inserted under and behind the front facia of the gaming table or apparatus. Thus, the base plate can be selectively secured to, and removed from, the gaming table or apparatus with which it is being used by selectively inserting and removing the curved portions 39 behind the front facia of the gaming table or apparatus.

The upper surface of the base plate includes a first pair of longitudinal channels 44 and a second pair of longitudinal channels 46.

Figure 5:
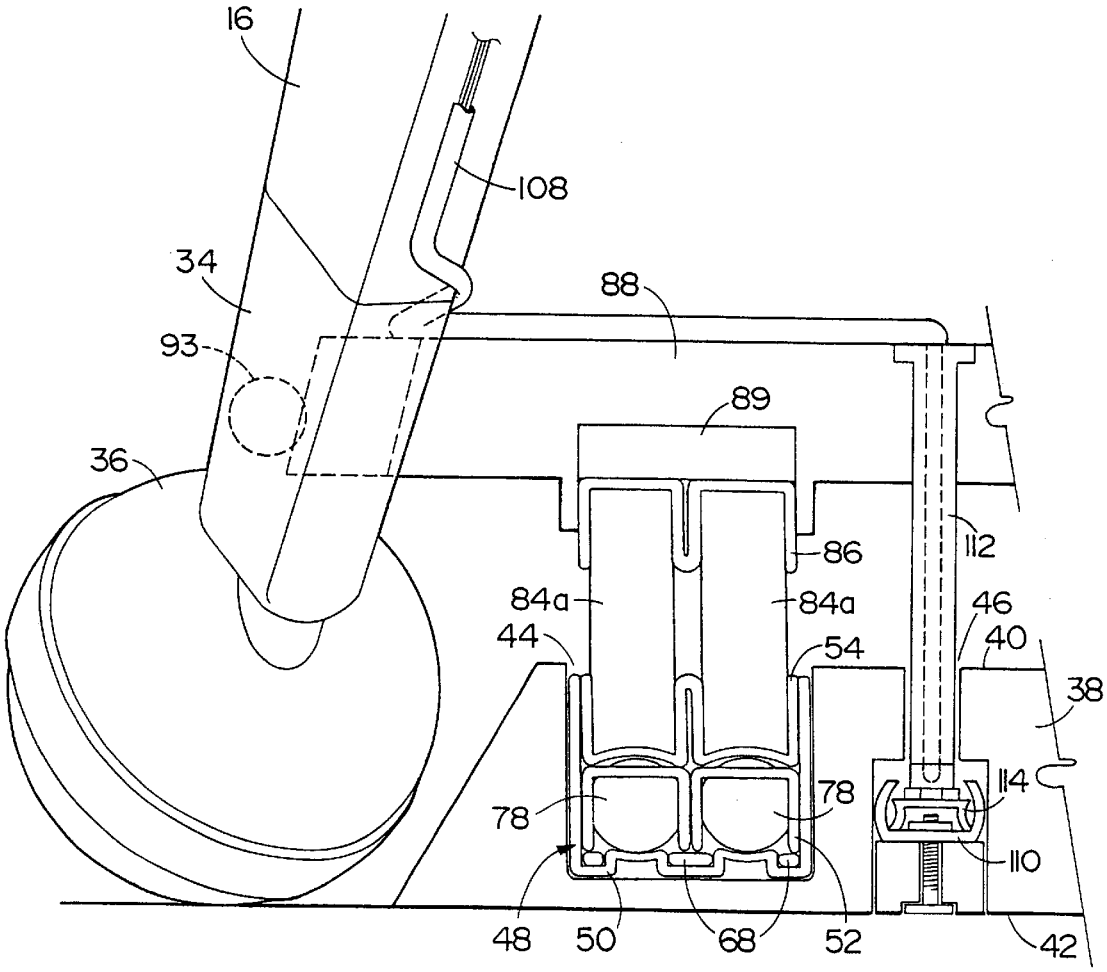
FIG. 5 is a sectional view taken along line 5—5 in FIG. 4.
Figure 6:
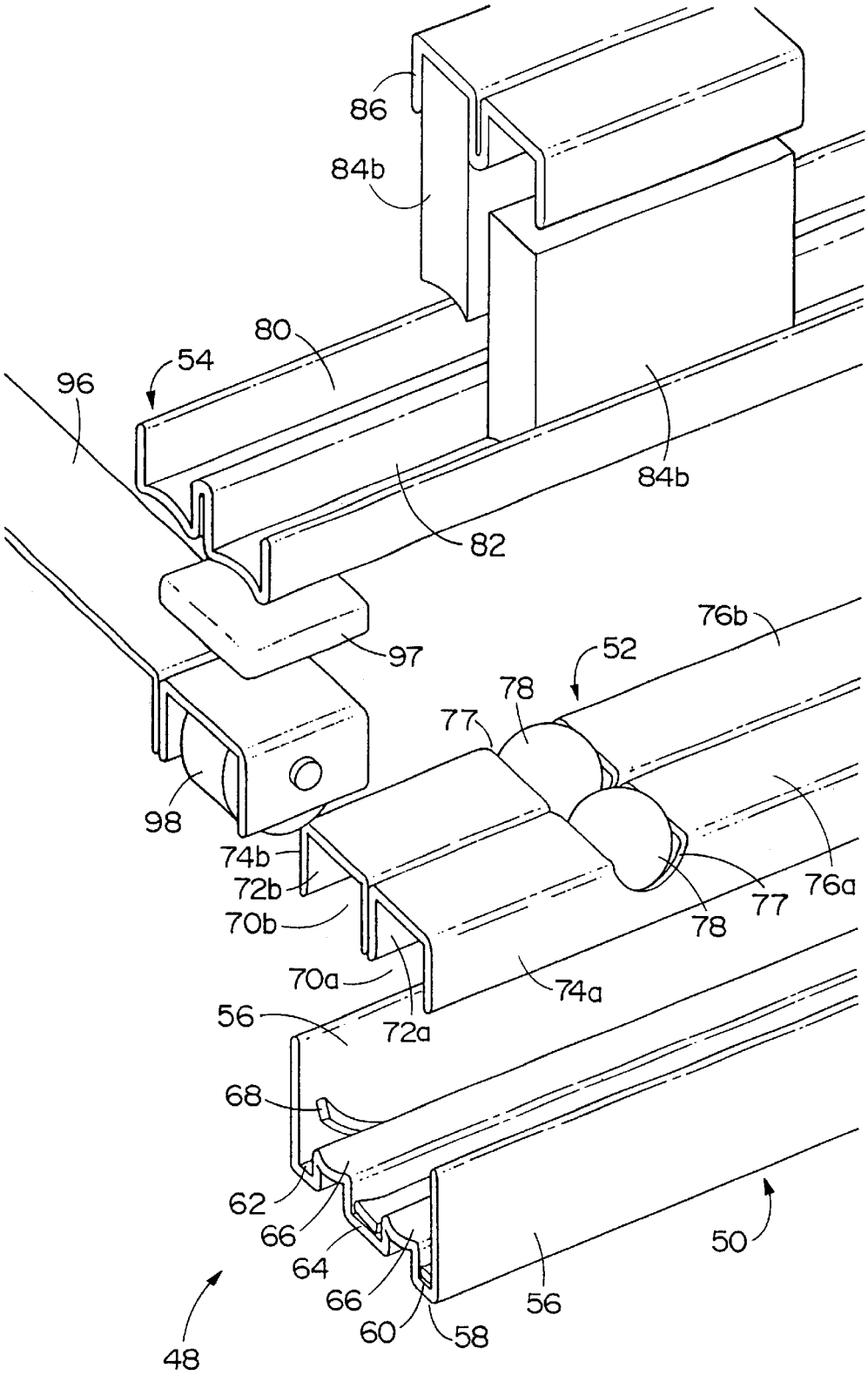
FIG. 6 detailed perspective view showing the slide members of the mounting assembly.

As best seen in FIGS. 5 and 6, each of the first pair of longitudinal channels 44 is adapted to receive a slide assembly 48. Each slide assembly 48 includes a stationary slide member 50, a carriage 52 and a movable slide member 54.

Each stationary slide 50 is adapted to be inserted and fixedly secured within a respective one of the pair of longitudinal channels 44. Each stationary slide 50 may be welded, affixed by adhesive or snap fit into the respective one of longitudinal channels 44. As seen in FIG. 5 and 6, each stationary slide member 50 includes an elongated generally U-shaped body having two vertical side walls 56 and a bottom wall 58. The bottom wall 58 is shaped such that it forms two runners 60 and 62, each one being interiorly adjacent one of the vertical side walls 56 and running the length of the slide member body. The bottom wall 58 is also shaped so that it forms a central runner 64 that runs the length of the stationary slide member body and is separated from each of the runners 60 and 62 by a pair of annular bearing surfaces 66.

Each stationary slide member 50 is further provided with liners 68 that are inserted within each of the runners 60 and 62, as well as the central runner 64. The liners act as cushions to absorb and isolate any shock generated during the user's entry and egress from the chair.

Each carriage 52 is inserted within a respective one of stationary slide member members 50 and fixedly secured therein by welding or adhesive. Alternatively, each carriage 52 may be snap fit within the slide member 50. Each carriage 52 includes an elongate housing having two inverted U-shaped halves 70*a* and 70*b* running the length of the carriage. Each halve includes opposed interior and exterior vertical walls, 72*a* and 74*a,* and, 72*b* and 74*b,* respectively. Each of the respective interior and exterior walls are interconnected by an associated horizontal upper wall, 76*a* and 76*b* respectively.

Each carriage 52 is configured so that the lower terminal ends of each of the exterior vertical walls, 74*a* and 74*b* respectively, are received within the runners 60 and 62 of the bottom wall of the stationary slide member 50. Both of the interior vertical walls 72*a* and 72*b* of the carriage 52 are received within the central runner 64 of the bottom wall of the stationary slide member 50.

Each of the horizontal upper walls 76*a* and 76*b* is provided with a plurality of through holes 77 equally spaced along the length of the carriage 52. The through holes are positioned at 3" intervals. The through holes 77 are adapted so that they partially expose ball bearings 78 and permit the bearings 78 to rotate within annular bearing surfaces 66 of stationary slide member 50. The through holes 77, together with the annular bearing surfaces 66, also serve to maintain the longitudinal position of the bearings 78 constant while still allowing the bearings to rotate.

Each movable slide member 54 has an elongate body including two U-shaped channels 80 and 82 extending the length of the member. The bottom wall of each movable slide member 54 is shaped to form two annular bearing surfaces adapted to engage the exposed surfaces of bearings 78, as best seen in FIG. 5. In this manner, the movable slide member 54 can ride smoothly on top of the of the exposed bearings 78.

Figure 4:
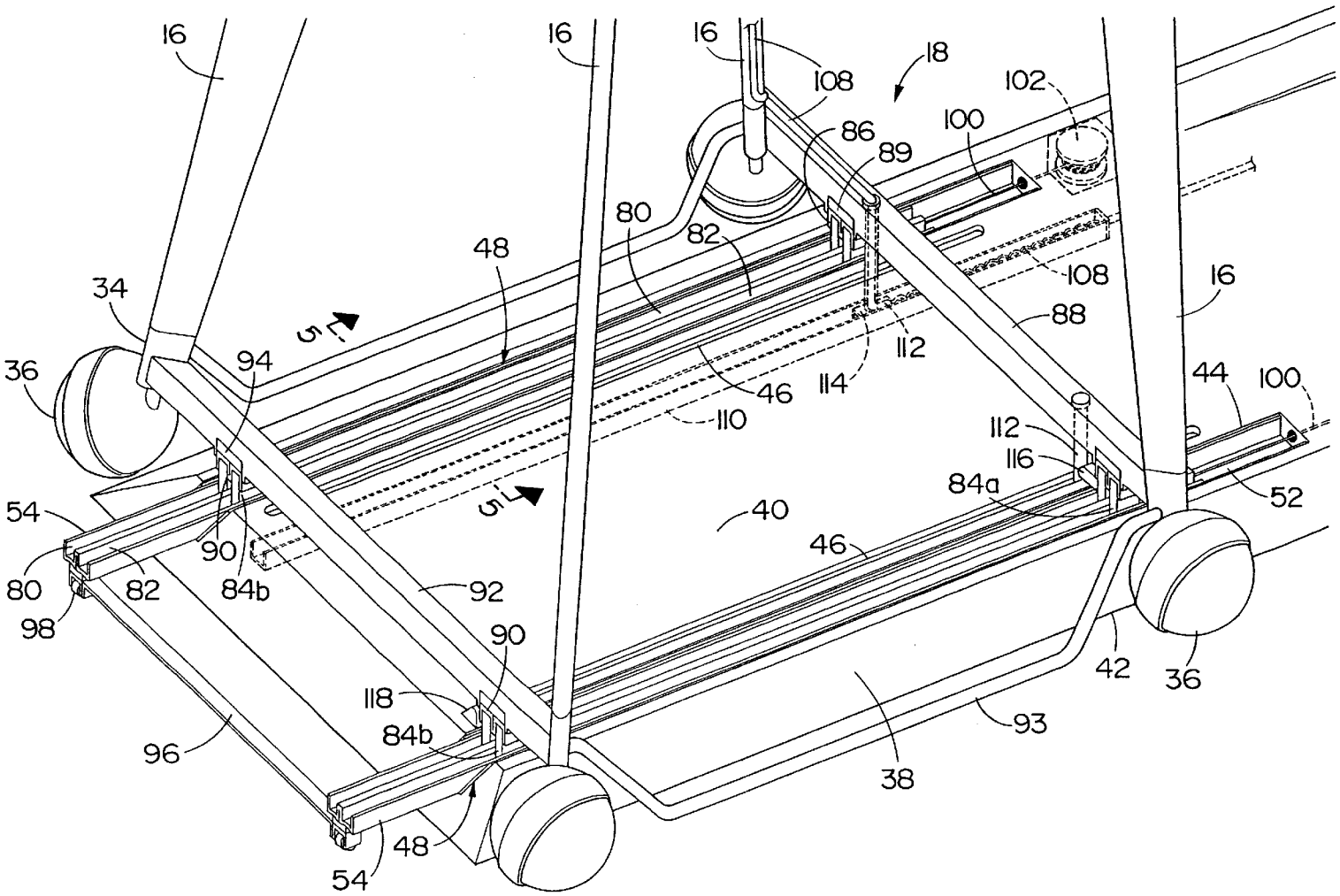
FIG. 4 is a detailed perspective view showing the mounting assembly of the casino chair according to the present invention.

As best seen in FIG. 4, each of the U-shaped channels 80 and 82 is adapted to receive one of a first pair of vertical posts 84*a*. Each of the posts 84*a* is secured at a first end to a bracket 86 which in turn is secured to a front cross beam 88. Each one of the vertical posts 84*a* is fixedly secured at their second end within a respective one of the channels 80 and 82. The posts may be adhered to the movable side member 54 using an adhesive or welded directly to the movable slide member 54. Interposed between the bracket 86 and the cross beam 88 is a support member 89 adapted to serve as a cushion to the cross beam 88.

Each of the U-shaped channel 80 and 82 is also adapted to receive, near its opposite end, a second pair of vertical posts 84*b*. Each one of the vertical posts 84*b* is secured at a first end to a bracket 90 which in turn is secured to a rear cross beam 92. The rear cross beam 92 interconnects the rear legs of the chair, as shown. Each one of the vertical posts 84*b* is fixedly secured at their second end within a respective one of the channels 80 and 82. The posts may be adhered to the movable side member 54 using an adhesive or welded directly to the movable slide member 54. Interposed between the bracket 90 and the cross beam 92 is a support member 94 adapted to cushion the cross beam 92.

When an obese individual sits in the chair according to the present invention the casters 36 may have a tendency to dig deeper into the casino carpet. The support members 89 and 94 described above will compress and compensate to maintain the chair in a level position.

The front and rear legs along each side of the chair are interconnected by a support bar 93. The support bar 93 serves to reinforce the legs of the chair and stabilize the same.

As best seen in FIG. 4, the respective movable slide members 54 of each slide assembly 48 are interconnected at their rear terminal ends by a cross support member 96. The cross support member 96 is provide with rolling means 98 that depend therefrom and promote the smooth movement of the movable slide members during operation of the chair. Interposed between each movable slide member and the cross support member 96 is a cushion 97 that serves to absorb and isolate any shock generated during the movement of the chair.

Secured to the front terminal end of each moveable slide member 54 of each slide assembly 48 is means for automatically returning the to position "A", that is the position adjacent the gaming table, when the chair is not in use.

As shown in FIG. 4, the means for automatically returning the chair to a position adjacent the gaming table comprises a cable 100 attached to the front terminal end of the movable slide member 54. The second end of the cable is secured to a spring loaded rotatable spool 102 that is adapted to rotate and retract the cable 100 when the chair is vacated. In this manner, the chair is automatically returned to the position "A" adjacent the gaming table when it is not in use.

As an alternative to the structure described above, a constant force spring may be wound around a fixed spool with a cable attached at one end to the spring and at the other end to the slide 82. In this manner, when the seat is vacated the constant force spring will act to retrieve the cable thereby drawing the chair adjacent the table when not in use.

In either case, the means for automatically returning the chair to a position adjacent the gaming table will serve to maintain the aisle clear and orderly. This will not only serve the obvious aesthetic objectives of the casino but also increase useable gaming space.

As shown in FIG. 3, the chair is also provided with a slide assembly 104 mounted to the bottom surface 22 of the seat 12. The slide assembly is secured in a conventional manner to a smoke removal apparatus 106 to enable the smoke removal apparatus to be selectively positioned to either side of the chair. The slide assembly is a conventional two way travel slide of the type manufactured by Accuride International, Inc., 12311 Shoemaker Ave., Santa Fe Springs, Calif. 97670. Specifically, the slide assembly 104 employed in the present invention is commercially available as ACCURIDE Model 2002. The two slide enables the smoke removal apparatus 106 to be selectively positioned to either side of the chair and easily used by both right handed and left handed smokers.

As shown in FIG. 4, electrical power is delivered to the smoke removal apparatus 106 by an electrical lead 108 that travels through an access channel 110 in the base plate 38. The electrical lead 108 enters into the front portion of the access channel 110 and then passes through a protective conduit 112. As shown in FIG. 5, one end of the protective conduit 112 is secured to a slide member 114 adapted to travel along and within the access rail 110 while the opposite end passes through and is secured to cross beam 88. The slide member 114 travels within the access rail 110, simultaneously with the movement of the chair. Likewise, the protective conduit 112 travels conjointly with the slide member 114. The protective conduit 112 serves to protect the electrical lead 108 during the movement of the chair. The protective conduit 112 also serves as a secondary stop means when the chair is moved to position B spaced from the gaming table. Finally, the protective conduit 112 serves to prevent the chair from tipping backwards as it is securely mounted to the slide member 114 which in turn received within the access rail 110.

The chair according to the present invention as described above may also be provided with a swivel assembly permitting the chair to be rotated during entry and egress from the gaming table. The swivel assembly would be mounted to between the seat of the chair and a stationary mounting plate to which the legs of the chair would be secured. In this manner, the seat may be rotated or swiveled while the legs of the chair remain stationary.

During use of the chair according to the present invention, the user approaches the chair 10 and pulls it away from the gaming table to position B. During the movement of the chair from position A adjacent the table T to a position B spaced from the table, the operation of each slide assembly 48 is a follows: (1) the movable slide member 54 moves outward conjointly with the chair until the chair reaches position B until (2) a stop member 116 which extends from one of the vertical posts 84*a,* as seen in FIG. 4, abuts a bumper 118 to prevent any further outward movement of the chair. The user then occupies the chair, extends their arms forward, grasps the apron of the gaming table and draws the chair from position B to position A adjacent the table.

When the user has finished play at the table, the chair is pushed away from the table until the chair is spaced from the table allowing the user to easily exit the chair. Once the player has exited the chair, the means for automatically returning the chair to a position adjacent the gaming table is activated and returns the chair to position A.

From the foregoing description, it can be seen that the present invention comprises an improved casino chair. It will be appreciated by those skilled in the art that changes could be made to the preferred embodiment described above without departing from the scope and spirit of the present invention. It is understood, therefore, that this invention is not limited to the particular embodiment disclosed, but is intended to cover modifications within the spirit and scope of the present invention as defined by the appended claims.

What is claimed is:

1. A casino chair selectively movable from a first position adjacent a casino gaming table to a second position spaced from said gaming table, said chair comprising a seat, a plurality of legs extending from said seat each having a terminal end, a mounting assembly for operably mounting said chair proximate to the casino gaming table including means for selectively moving said chair from said first position to said second position and means for automatically returning said chair to said first position adjacent the gaming table when said chair is not occupied by a user said mounting assembly comprising a base plate having a pair of longitudinal channel means with which the terminal ends of the legs of said chair cooperate to guide said chair between said first and second positions.

2. The casino chair according to claim 1, wherein said terminal of said legs is provided with rolling means for facilitating movement of said chair.

3. The casino chair according to claim 1, wherein each of said terminal ends include a slide assembly, said slide assemblies being mounted within each said longitudinal channels for enabling the selective movement of said chair.

4. The casino chair according to claim 3, wherein said slide assembly includes a stationary slide fixedly mounted within said longitudinal channel.

5. The casino chair according to claim 4, wherein said slide assembly further comprises a carriage fixedly secured within said stationary slide, said carriage having a plurality of bearings spaced along the length of said carriage.

6. The casino chair according to claim 5, wherein said slide assembly further comprises a movable slide member mounted to said chair and adapted to move relative to said carriage conjointly with said chair.

7. The casino chair according to claim 1, including a slide assembly mounted to an undersurface of seat for positioning a smoke removal apparatus to either side of said chair.

* * * * *